US006743086B2

(12) United States Patent
Nelson et al.

(10) Patent No.: US 6,743,086 B2
(45) Date of Patent: Jun. 1, 2004

(54) ABRASIVE ARTICLE WITH UNIVERSAL HOLE PATTERN

(75) Inventors: Eric W. Nelson, Stillwater, MN (US); James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 233 days.

(21) Appl. No.: 09/928,157

(22) Filed: Aug. 10, 2001

(65) Prior Publication Data

US 2003/0032383 A1 Feb. 13, 2003

(51) Int. Cl.[7] ..... B24D 3/28

(52) U.S. Cl. ..... 451/527; 451/357; 451/359; 451/456

(58) Field of Search ..... 451/354, 356, 451/357, 358, 359, 456, 527, 533, 539, 548

(56) References Cited

U.S. PATENT DOCUMENTS

| | | | | |
|---|---|---|---|---|
| 2,819,568 A | * | 1/1958 | Kasick | 451/488 |
| 4,058,936 A | * | 11/1977 | Marton | 451/359 |
| 4,062,152 A | * | 12/1977 | Mehrer | 451/344 |
| 4,937,984 A | * | 7/1990 | Taranto | 451/524 |
| 5,036,627 A | | 8/1991 | Walters | |
| 5,054,246 A | | 10/1991 | Phaal et al. | |
| 5,174,795 A | | 12/1992 | Wiand | |
| 5,363,604 A | | 11/1994 | Heyer | |
| 5,367,839 A | * | 11/1994 | Pearce | 451/526 |
| 5,453,040 A | * | 9/1995 | Schaal et al. | 451/344 |
| 5,489,233 A | | 2/1996 | Cook et al. | |
| 5,525,100 A | | 6/1996 | Kelly et al. | |
| 5,527,212 A | | 6/1996 | Bowen et al. | |
| 5,782,682 A | | 7/1998 | Han et al. | |
| 5,807,161 A | | 9/1998 | Manor et al. | |
| 5,810,650 A | * | 9/1998 | Jost | 451/527 |
| 5,849,051 A | | 12/1998 | Beardsley et al. | |
| 5,853,317 A | | 12/1998 | Yamamoto | |
| 5,989,112 A | * | 11/1999 | Long et al. | 451/527 |
| 6,110,031 A | | 8/2000 | Preston et al. | |
| 2003/0003856 A1 | * | 1/2003 | Swei | 451/526 |

FOREIGN PATENT DOCUMENTS

| | | |
|---|---|---|
| DE | 40 32 330 A1 | 4/1992 |
| WO | WO 00/37218 | 6/2000 |

* cited by examiner

*Primary Examiner*—Timothy V. Eley
(74) *Attorney, Agent, or Firm*—David B. Patchett

(57) ABSTRACT

A universal abrasive article adapted to mount on a mounting surface of a sanding machine having a plurality of dust extraction holes that define an open area. The abrasive article includes a plurality of discrete apertures that are sized and positioned so as to expose a majority of the open area of the dust extraction holes independent of the angular orientation of the abrasive article when the abrasive article is in registration with the mounting surface. The discrete apertures may include elongated, arcuate slots that may be symmetrically positioned about a center point of the abrasive article. In one embodiment, the discrete apertures may include seven arcuate slots. These embodiments also include sufficient abrasive material to provide adequate sanding cut rate and structural integrity during use and removal.

16 Claims, 5 Drawing Sheets

ABRASIVE ARTICLE WITH UNIVERSAL HOLE PATTERN

FIELD OF THE INVENTION

This invention relates to abrasive article having universal hole patterns for use on sanding machines having differing extraction hole patterns.

BACKGROUND OF THE INVENTION

Today, many different manufacturers sell orbital or random orbit sanding machines or sanders usable with removable and replaceable abrasive discs that are typically mounted to a back-up pad. Many of these sanding machines include integral or attachable vacuum extraction systems. However, these sanding machines are currently available with many different extraction hole patterns formed within the backup pad for use with the extraction systems. The extraction systems help to remove the large amount of dust and particles generated by the sanding process. This dust is not only a nuisance and a cleanliness issue, but can also cause health concerns and limit the useful life of the abrasive disc. Abrasive discs for use with these different sanders are available with the discs adapted to the different dust extraction hole patterns and numbers of holes in each pattern. This allows the sanding dust to be effectively removed from the work piece while the sanding operation is being performed, which helps maintain a cleaner work environment and prolong the life of the abrasive disc.

In the U.S. retail market, there are two predominate extraction hole patterns for sanding machines using five inch diameter sanding or abrasive discs. FIG. 1 illustrates a mounting surface 20 for a dust extraction system having five dust extraction holes 22 each with diameters of about ⅜ inch (9.53 millimeters) that are located on about a 2.766 inch (70.26 millimeter) diameter circle. FIG. 2 illustrates a mounting surface 24 for a dust extraction system having eight dust extraction holes 26 each with diameters of about ⅜ inch (9.53 millimeters) that are located on about a 2.626 inch (66.70 millimeter) diameter circle. The holes 22, 26 are fluidly coupled to an extraction manifold. The mounting surfaces 20, 24 can be located directly on the sanding machine or can be an intermediate back-up pad, such as a foam or non-woven material, attached to the sanding machine.

Prior art abrasive discs typically include a pattern of holes that substantially correspond to the pattern of holes 22, 26 illustrated in FIGS. 1 and 2. The prior art abrasive discs must be oriented so that their holes are substantially aligned with the holes 22, 26 on the mounting surfaces 20, 24, respectively.

Use of these discs includes attachment of the discs, usually by adhesive, hook and loop fasteners or other conventional means, onto the back-up pad of the sander being used while aligning the hole pattern in the abrasive disc with the extraction hole pattern in the back-up pad. Effective functioning of the dust extraction system does not require a 100 percent alignment between the holes in the disc and the extraction holes resulting in 100 percent exposure of the extraction holes. Rather, it has been found that an alignment or exposure of 75 percent or greater is generally preferred for efficient operation of the extraction system.

Due to the lack of hole pattern standardization, numerous dust extraction hole patterns are currently available on sanding machines. Therefore, abrasive disc manufacturers, wholesale sellers and retailers must make and/or stock discs with each pattern in all ranges of abrasive grit for use with these sanding machines. This increases the cost, inconvenience and stocking difficulty in trying to meet the customer's needs. In order to reduce these problems, attempts have been made to provide a solution to the multiple pattern situation. U.S. Pat. No. 5,989,112 (Long et al.) discloses an abrasive disc having an eight hole pattern in which some of the holes are enlarged to encompass some of the holes of the five hole pattern. U.S. Pat. No. 5,810,650 (Jöst) discloses the provision of a multitude of smaller holes or perforations distributed evenly over the surface of the abrasive disc, which don't necessarily align directly with the smaller number of larger dust extraction holes in the sanding machine.

SUMMARY OF THE INVENTION

The present invention is directed to an abrasive article with a plurality of apertures that can be used with at least two different dust extraction systems each having a different number or configuration of dust extraction holes. The number of apertures in the abrasive article corresponds generally to the number of dust extraction holes. The apertures are typically concentrated in a region corresponding to the location of the dust extraction holes. The arrangement of the apertures permits the abrasive article to be mounted to the dust extraction system in any angular orientation when the abrasive article is in registration with the mounting surface. That is, the present abrasive article is orientation independent relative to the dust extraction holes, while still providing adequate exposure of the dust extraction holes by the discrete apertures.

One embodiment of the present abrasive article comprises a disc capable of being used with both the five-hole and eight-hole dust extraction patterns currently available commercially for sanding machines. The various embodiments illustrate apertures that may be readily aligned by the user with the dust extraction holes on the sander mounting surface without regard to angular orientation, while providing suitable extraction efficiency. These embodiments also include sufficient abrasive material to provide adequate sanding cut rate and structural integrity during use and removal.

The abrasive article of the present invention is adapted to mount on a mounting surface of a sanding machine having a plurality of dust extraction holes defining an open area. The abrasive article includes a plurality of discrete apertures sized and positioned so as to expose a majority of the open area of the dust extraction holes independent of the angular orientation of the abrasive article when the abrasive article is in registration with the mounting surface. For use with the abrasive article of the present invention, the plurality of dust extraction openings may include five or eight openings.

The abrasive article may be formed as elongated slots, and in particular, elongated, arcuate slots. The slots may have radiused ends. The discrete apertures may include elongated, arcuate slots each having an inner radius of about 1.13 inches (28.70 millimeters) from a center point of the abrasive article and a width of about 0.44 inches (11.18 millimeters). In one embodiment, the discrete apertures may include seven elongated, arcuate slots each having an arc length that ranges from about 0.87 inches (22.10 millimeters) to about 1.06 inches (26.92 millimeters). Alternatively, the discrete apertures may include three elongated, arcuate slots each having an arc length that ranges from about 2.21 inches (56.13 millimeters) to about 2.57 inches (65.27 millimeters).

The discrete apertures may be symmetrically arranged around a center point of the abrasive article, and may be generally of the same size or of different sizes. The discrete apertures may be arcuate slots of differing lengths. In addition, the discrete apertures of the abrasive article may expose at least about 75% of the open area. They may also encompass an area less than about 30 percent of an area of the abrasive article. In one embodiment, the discrete apertures include seven discrete apertures and in another embodiment, the discrete apertures may include less than ten discrete apertures.

The present invention is also directed to a method of manufacturing a universal abrasive article adapted to mount on a mounting surface of a sanding machine having a plurality of dust extraction holes defining an open area. The method includes the steps of providing an abrasive article suitable for mounting to the mounting surface, and forming a plurality of discrete apertures that are sized and positioned so as to expose a majority of the open area of the dust extraction holes independent of the angular orientation of the abrasive article when the abrasive article is in registration with the mounting surface.

DETAILED DESCRIPTION OF THE INVENTION

Figure 3:
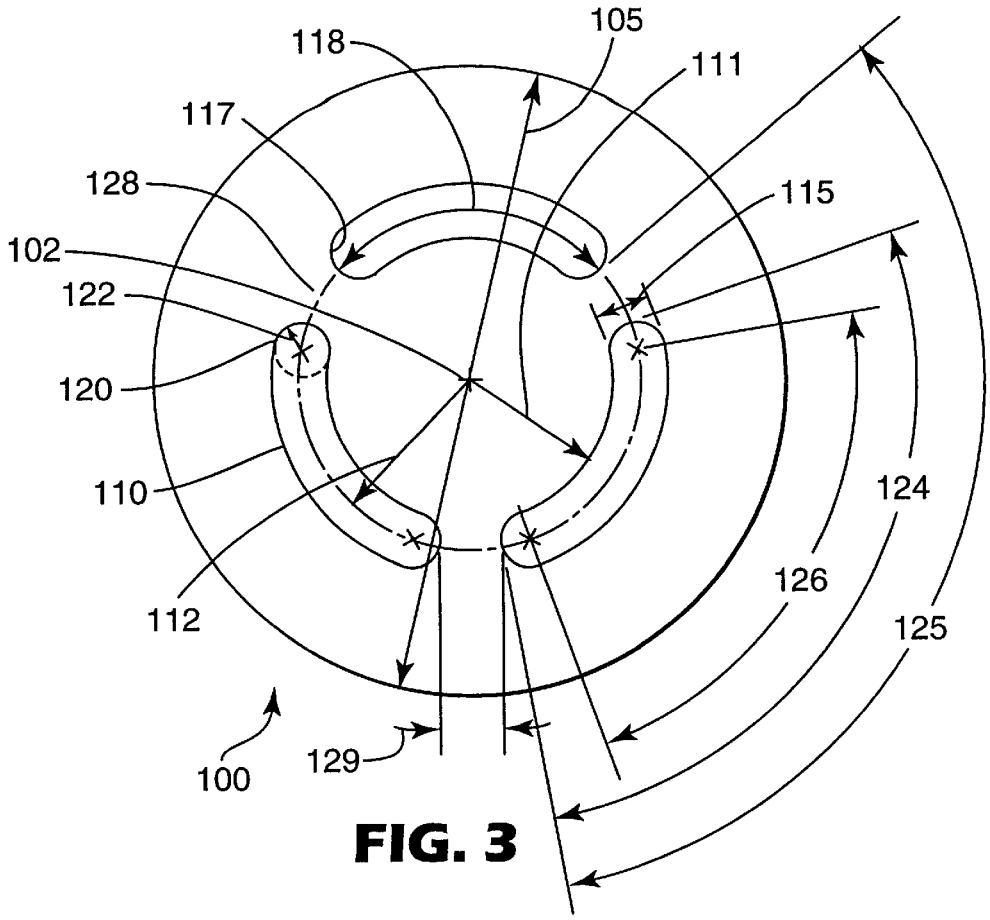
FIG. 3 is a top view of one embodiment of an abrasive disc including a universal hole pattern usable with both a five and an eight hole extraction hole pattern.

With reference to the attached Figures, it is to be understood that like components are labeled with like numerals throughout the several Figures. FIG. 3 shows one embodiment of a universal abrasive article 100 in accordance with the present invention. The abrasive article 100 is preferably a coated or structured abrasive article generally containing abrasive material, typically in the form of abrasive grains, bonded to a backing by means of one or more adhesive layers. The backings used in coated and structured abrasive articles are typically made of paper, polymeric materials, cloth, nonwoven materials, vulcanized fiber, or combinations of these materials.

The abrasive article 100 has a diameter 105 of about 5.0 inches (127 millimeters) to accommodate sanders having five inch (127 millimeter) diameter backup pads, as described above in the Background section. In the illustrated embodiment, the article 100 includes three discrete apertures 110 positioned generally symmetrically within the abrasive article 100 about a disc center point 102. The illustrated discrete apertures 110 are elongated arcuate slots, although a variety of other symmetrical or asymmetrical shapes can be used. As used herein, "discrete aperture" refers to an aperture that forms a single discrete pathway through an abrasive disc.

Each aperture 110 has an inner radial dimension 111 of about 1.13 inches (28.70 millimeters) and a width 115 of about 0.44 inches (11.18 millimeters) resulting in a center radial dimension 112 of about 1.35 inches (34.29 millimeters). Each aperture 110 has radiused ends 117 and an overall arc length 118 of about 2.33 inches (59.20 millimeters) or a slot angle 124 of about 99 degrees, with angular repetitive spacing 125 of about 120 degrees. These apertures 110 may be formed from a hole 120 having about a 0.22 inch (5.6 millimeter) radius 122, which is moved through an arc 126 of about 80 degrees.

Figure 1:
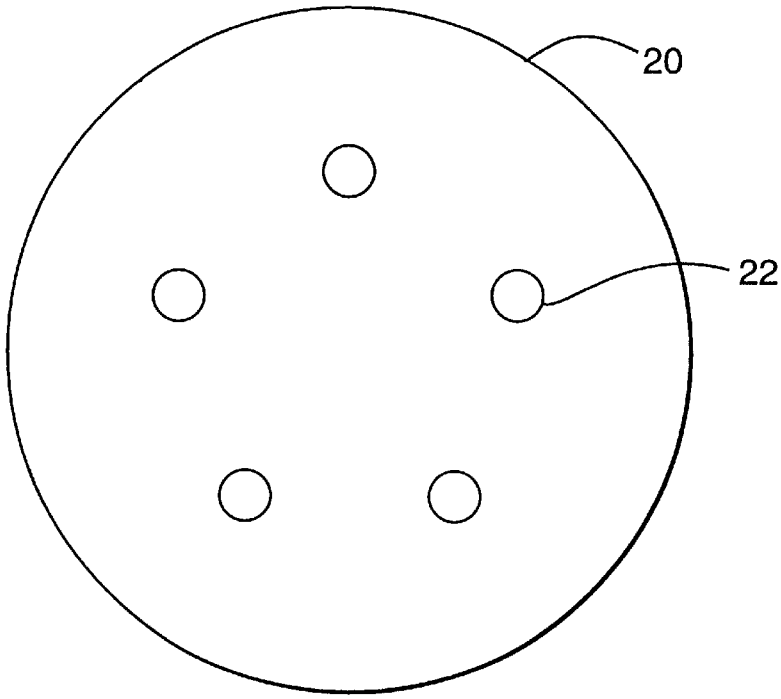
FIG. 1 PRIOR ART
FIG. 1 is a top view of a prior art back-up pad or an abrasive disc having a five hole extraction hole pattern.
Figure 2:
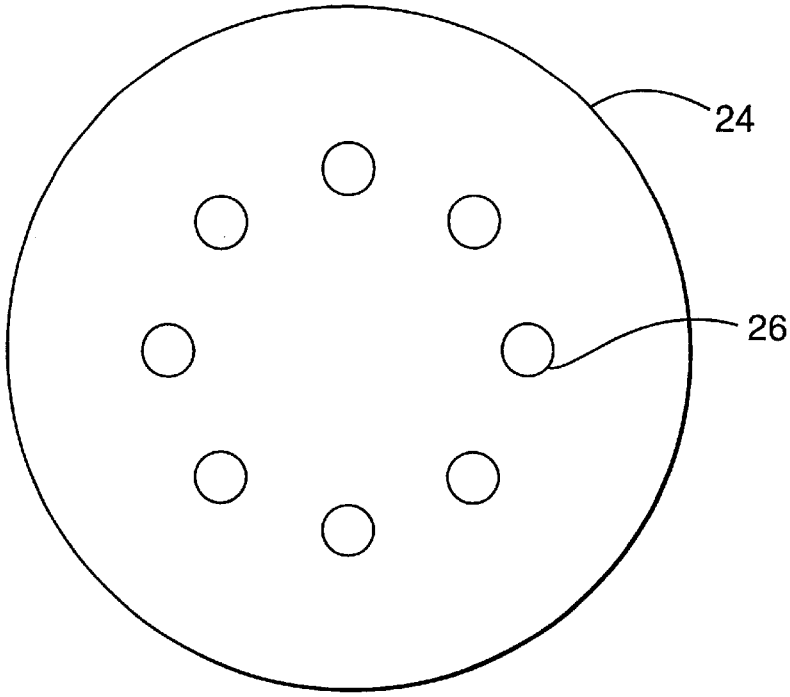
FIG. 2 PRIOR ART
FIG. 2 is a top view of a prior art back-up pad or an abrasive disc having an eight hole extraction hole pattern.
Figure 4:
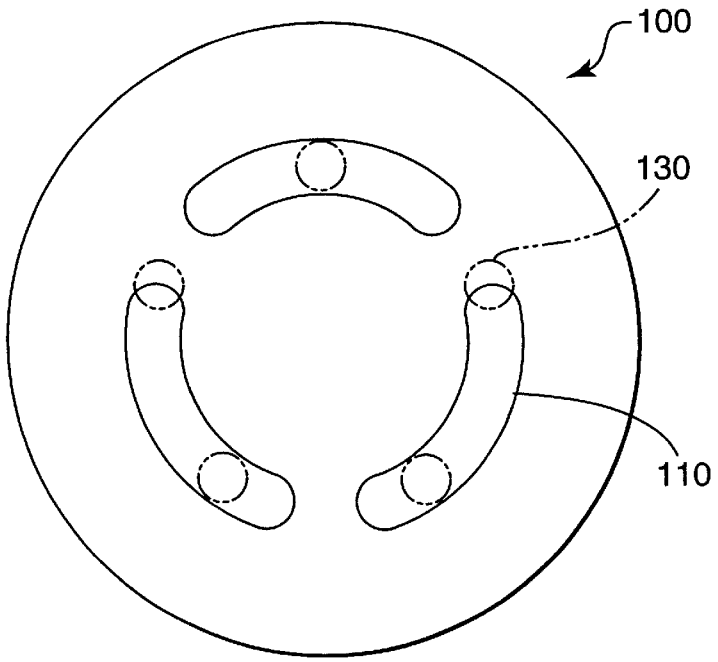
FIG. 4 is a top view of the abrasive article of FIG. 3 upon which the five-hole pattern of FIG. 1 is overlaid.
Figure 5:
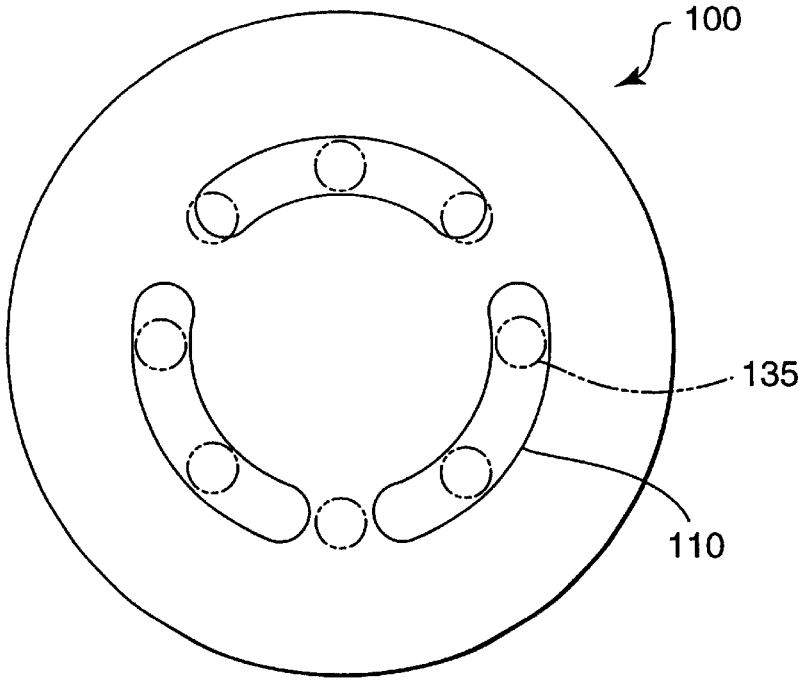
FIG. 5 is a top view of the abrasive article of FIG. 3 upon which the eight-hole pattern of FIG. 2 is overlaid.

Referring now to FIGS. 4 and 5, the abrasive article 100 is shown with the five-hole 130 (FIG. 4) and eight-hole 135 (FIG. 5) dust extraction system superimposed in phantom, respectively, on the abrasive article 100 to illustrate the relationship between the apertures 110 and the pattern of dust extraction holes 130, 135 when the abrasive article 100 is mounted or otherwise attached to a mounting surface (see e.g., FIGS. 1 and 2). As used herein, "mounting surface" refers to a surface adapted to receive an abrasive article such as a surface on the sanding machine or a surface on an intermediate back-up pad, such as a foam or non-woven, attached to the sanding machine. In an embodiment with a back-up pad, the apertures on the abrasive article are typically designed to correspond to the dust extraction hole pattern in the back-up pad.

Using simple geometry, it can be calculated that the three elongated apertures 110 are the preferred minimum to adequately expose both the five- and eight-hole dust extraction hole patterns 130, 135 to give a sufficient amount of dust extraction efficiency for the sanding machine, as well as to provide independence from orientation of the abrasive article 100. That is, the abrasive article 100 may be positioned at any angular orientation when it is placed in registration with the mounting surface, resulting in adequate and consistent exposure. As used herein, "registration" of an abrasive article refers to generally concentric alignment between the abrasive article and a mounting surface. As the abrasive article 100 is rotated about the center point 102 with respect to the dust extraction holes 130, 135, the amount of obstruction of the extraction holes 130, 135 by material 128 between the apertures 110 is counterbalanced by a relatively similar amount of exposure of the holes 130, 135 provided by the apertures 110. That is, as one or more holes 130, 135 are closed off by material 128 between the apertures 110, one or more holes 130, 135 are opened or exposed by apertures 110 in about an equal amount.

As is clear, the three apertures 110 do not provide complete exposure of either hole pattern 130, 135. However, as stated above, 100 percent exposure is not required to meet the extraction efficiency requirements of these types of sanding machines. The exposure of the dust extraction holes 130, 135 provided by the three apertures 110 is adequate to meet the preferred 75 percent exposure for efficient operation of the sanding machine and extraction system. For some applications, less than 75 percent exposure may be acceptable, allowing for considerable variation in the number, size and configuration of the apertures 110. For example, an exposure of greater than 50 percent is used for some embodiments.

The three aperture pattern provides sufficient abrasive surface area to minimize the effect of the pattern on the sanding performance of the abrasive article 100, as characterized by cut rate. The cut rate typically represents the amount of sanded material removed per unit time. In general, it is preferable to provide an abrasive article 100 in which no more than about 30 percent of the abrasive surface area has been removed due to formation of the apertures 110 or other features, in order to meet the cut rate performance criteria. In addition, the three aperture pattern of abrasive article 100 maintains a sufficient amount of backing 128 between the apertures 110 in order to provide adequate structural integrity and strength, even when the abrasive article 100 is formed from the weakest backing material. Adequate strength and structural integrity are necessary to minimize the possibility of tearing of the abrasive article 100 during use and removal of the abrasive article 100 from the mounting surface. This feature is important for abrasive articles that are mounted using adhesive or hook and loop type fasteners. In this embodiment, the material 128 remaining between the apertures 110 has a material width 129 of about 0.50 inches (12.70 millimeters).

Figure 6:
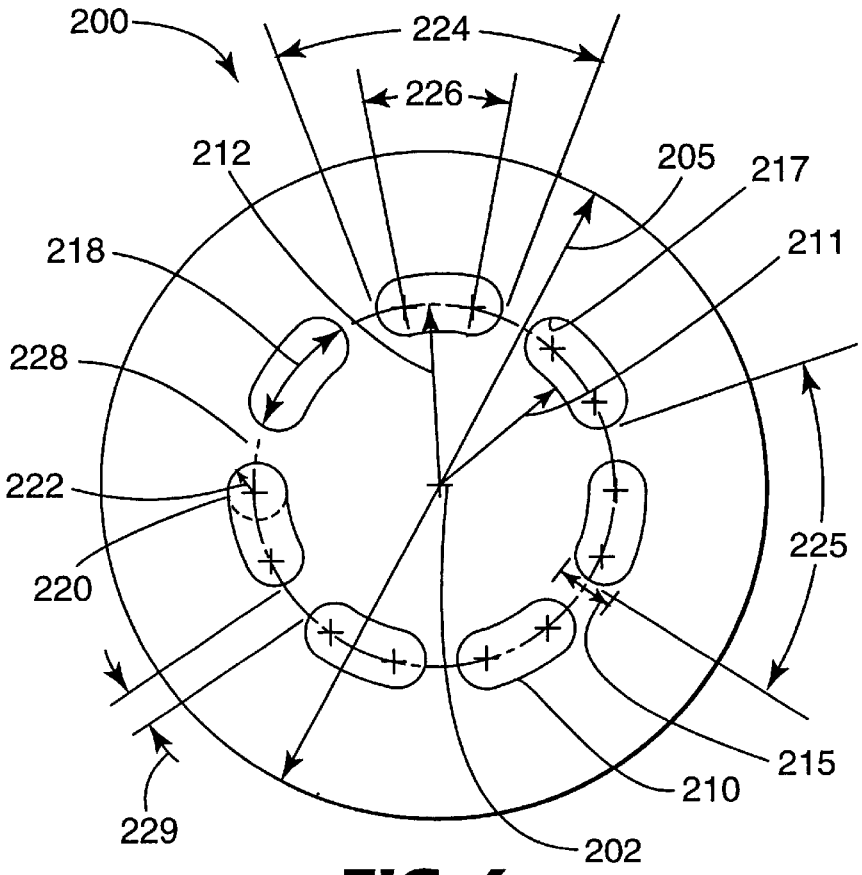
FIG. 6 is a top view of another embodiment of an abrasive article including a universal hole pattern usable with both a five and an eight hole extraction hole pattern.
Figure 7:
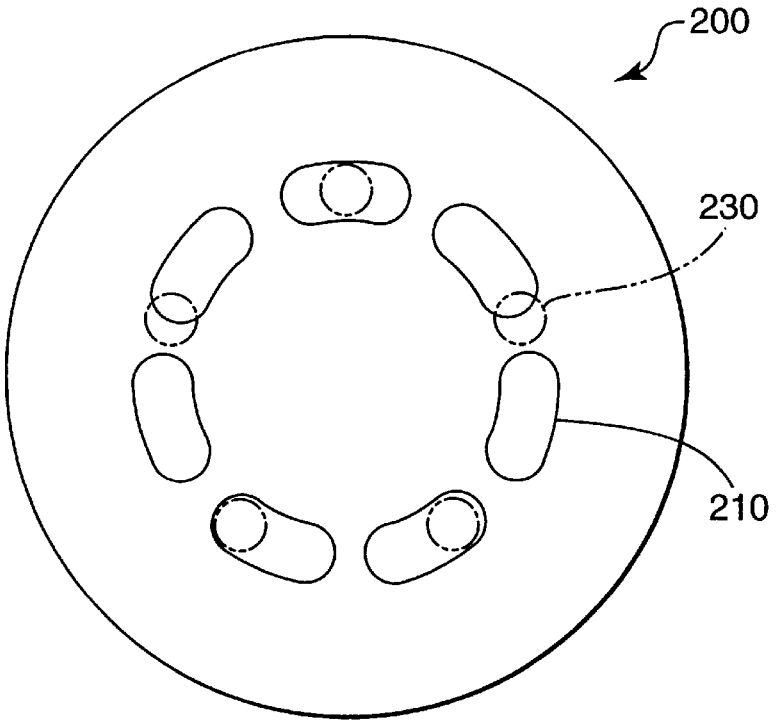
FIG. 7 is a top view of the abrasive article of FIG. 6 upon which the five-hole pattern of FIG. 1 is overlaid.
Figure 8:
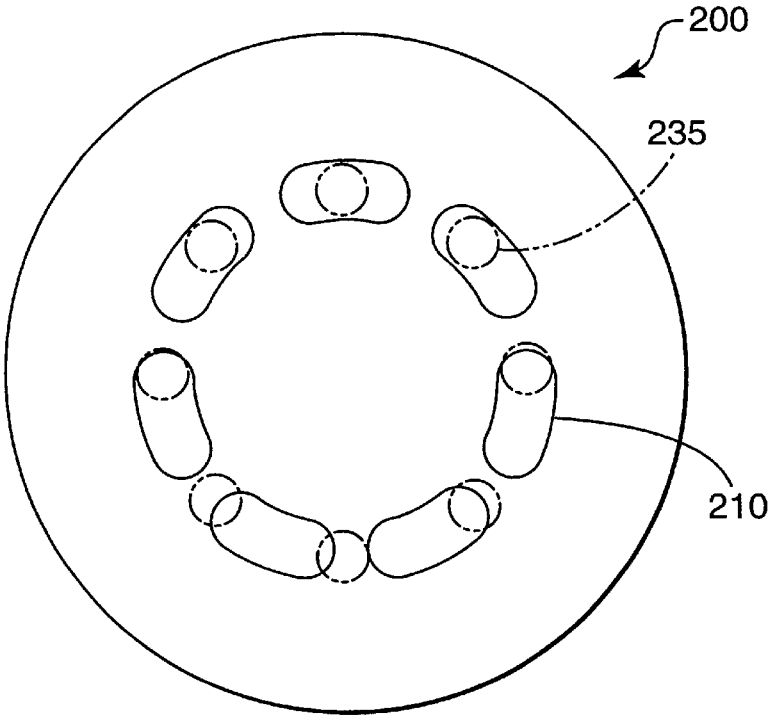
FIG. 8 is a top view of the abrasive article of FIG. 6 upon which the eight-hole pattern of FIG. 2 is overlaid.

Using the same geometrical calculations, it can be determined that the next lowest number of equally sized apertures that may be provided to adequately expose both the five- and eight-hole patterns is seven elongated slots. Referring now to FIGS. 6–8, another embodiment of a universal abrasive article 200, in accordance with the present invention, is shown with the abrasive article 200 including seven apertures 210 positioned generally symmetrically within the abrasive article 200 about a disc center point 202. In the illustrated embodiment, the apertures 210 are arcuate, elongated slots.

As with the three aperture pattern of abrasive article 100, the resulting abrasive article 200 is orientation independent of the dust extraction holes 230, 235 (see FIGS. 7 and 8). Although more than seven apertures are possible, such as nine or eleven, less apertures are easier and more cost effective to produce and thus are preferred.

As with the prior embodiment, the abrasive article 200 has a diameter 205 of about 5.0 inches (127 millimeters) to accommodate sanders having five inch (127 millimeter) diameter back-up pads, as described above in the Background section. In this embodiment, each aperture 210 has an inner radial dimension 211 of about 1.13 inches (28.70 millimeters) and a width 215 of about 0.44 inches (11.18 millimeters) resulting in a center radial dimension 212 of about 1.35 inches (34.29 millimeters). Each aperture 210 has radiused ends 217 and an overall arc length 218 of about 0.97 inches (24.53 millimeters) or a slot angle 224 of about 41 degrees, with angular repetitive spacing 225 of about 51 degrees. These apertures 210 may be formed from a hole 220 having about a 0.22 inch (5.6 millimeter) radius 222, but in this embodiment, each hole 220 is moved through an arc 226 of about 22 degrees.

Referring now to FIGS. 7 and 8, the abrasive article 200 is shown with the five-hole 230 and eight-hole 235 dust extraction hole patterns superimposed in phantom, respectively, on the abrasive article 200. The seven apertures 210 do not completely expose either hole pattern. The exposure provided by the seven apertures 210 is adequate to meet the preferred 75 percent amount of exposure for efficient operation of the sanding machine and extraction system when the abrasive article 200 is placed in registration with the mounting surface. At any orientation, the seven apertures 210 result in a calculated amount of exposure of over about 80 percent.

The seven aperture pattern of abrasive article 200 also provides sufficient abrasive material to minimize the effect of the pattern on the cut rate of the abrasive article 200. As previously stated, it is preferable to provide an abrasive article 200 in which no more than about 30 percent of the abrasive surface area has been removed due to formation of the slots 210 or other features, in order to meet the cut rate performance criteria. In this embodiment, it is calculated that only about 11 percent of the surface area of the abrasive article 200 has been removed, and testing has shown no substantial loss of performance for this embodiment.

In addition, the seven aperture pattern of abrasive article 200 maintains a sufficient amount of backing material 228 between the apertures 210 in order to provide adequate structural integrity and strength, even when the abrasive article 200 is formed from the weakest backing material. As stated above, adequate strength and structural integrity are necessary to minimize the possibility of tearing of the abrasive article 200 during use and removal of the abrasive article 200 from a mounting surface. In this embodiment, the material 228 remaining between the apertures 210 has a material width 229 of about 0.25 inches (6.35 millimeters). Not only does this material 228 meet the strength requirements, but also has the added advantage of being narrower than a dust extraction hole 230, 235 positioned under the material 228 in certain angular alignments of the abrasive article 200, thereby providing at least some exposure of the dust extraction hole 230, 235 even when it is overlapped by the material 228.

Although the above embodiments illustrate specific aperture sizes based on specific inner radii 111, 211, width 115, 215 and arc length 118, 218 dimensions, it is to be understood that other aperture dimensions are also possible. In the seven aperture pattern, the arc angle 224 may range from about 37 degrees or less to about 45 degrees or more, providing a material width 229 of about 0.16 inches (4.06 millimeters) to about 0.34 inches (8.64 millimeters) between the slots 210. In addition, although shown with all apertures 110, 210 having the same size and symmetrically positioned around the center point 102, 202 of the abrasive article 100, 200, size variations, length variations and positioning variations are also possible and are within the scope of the present invention.

In the three aperture pattern, the arc 124 may range from about 94 degrees or less to about 109 degrees or more, providing a material width 129 of about 0.26 inches (6.6 millimeters) to about 0.57 inches (14.48 millimeters) between the apertures 110. Limiting factors for these dimensions include the provision of an adequate amount of material 128, 228 between the apertures 110, 210 so that sufficient strength is provided during use and removal, as well as providing sufficient abrasive material for adequate cut rate performance. A counterbalancing factor for these dimensions is the need to limit the amount of material 128, 228 so as not to block more of the extraction holes than is necessary, which may drop the amount of exposure down below 50–75 percent and thus impair the extraction efficiency of the sanding machine. It has been found that larger amounts of material widths 129, 229 are preferred when small numbers of material areas 128, 228 are provided, such as in abrasive article 100 having only three such material areas 128. When more material areas are provided, such as in abrasive article 200 having seven areas 228, each area 228 may be smaller in material width 229 while still providing a similar amount of structural integrity and strength.

Figure 9:
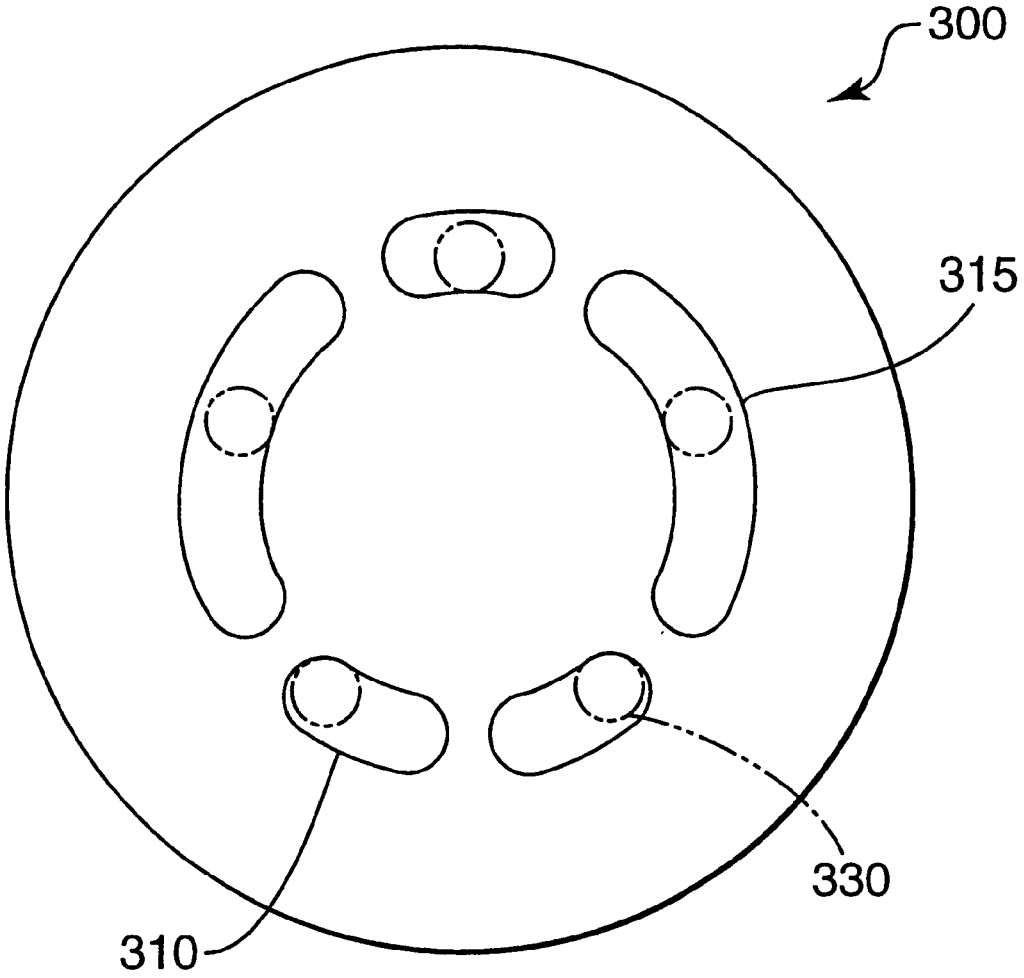
FIG. 9 is a top view of yet another embodiment of an abrasive article including a universal hole pattern usable with both a five and an eight hole extraction hole pattern.

Referring now to FIG. 9, an abrasive article 300 is shown with the five-hole pattern 330 superimposed in phantom on the abrasive article 300. In this embodiment, there are five apertures 310, 315 of varying sizes. Other aperture variations are also possible, including but not limited to the size and shape of the apertures 310, 315 and the orientation of the apertures 310, 315. For example, the width or inner radius, length or angle of the aperture, number of apertures, symmetry or lack of symmetry, and combinations of the same can be varied depending upon the application. Although provision of aperture numbers other than three or seven is possible and may produce exposure of up to 100 percent at some angular orientations, use of other numbers of apertures may impair the orientation independence of the resulting abrasive article. Such a result has the effect of lessening the user friendliness of the abrasive article and may ultimately result in inefficient sanding because some orientations of the abrasive article may produce less than the preferred amount of exposure of the dust extraction holes 330.

Formation of the abrasive articles 100, 200, 300 may be achieved through a number of manufacturing processes. These processes may include punching or cutting by methods including, but not limited to, die cutting, water jet cutting, laser cutting, milling or other suitable techniques. Symmetrical apertures that are all the same size are generally easier to form in a manufacturing process than more complex designs, and thus are more cost effective. However, it is to be understood that the universal abrasive articles of the present invention are not limited by formation method or formation considerations.

While the present invention is illustrated using conventional five and eight hole dust extraction systems, it is adaptable to dust extraction systems having different numbers and configurations of dust extraction holes. Other size mounting surfaces are also available on the market which may also provide the need for universal abrasive articles. Abrasive articles in accordance with the present invention may also be produced to meet the size and number of extraction holes of these other sanding machines based on the design methodology described above, preferably resulting in abrasive articles that meet the necessary extraction efficiencies, abrasive cut rate characteristics and structural integrity and strength requirements, while maintaining orientation independence.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. An abrasive article adapted to mount on a mounting surface of a sanding machine having a plurality of dust extraction holes defining an open area, the abrasive article comprising a plurality of discrete elongated arcuate apertures sized and positioned so as to expose a majority of the open area of the dust extraction holes independent of the angular orientation of the abrasive article when the abrasive article is in registration with the mounting surface.

2. The abrasive article of claim 1, wherein the discrete apertures comprise slots with radiused ends.

3. The abrasive article of claim 1, wherein the discrete apertures comprise apertures symmetrically arranged around a center point of the abrasive article.

4. The abrasive article of claim 1, wherein the discrete apertures comprise apertures of generally the same size.

5. The abrasive article of claim 1, wherein the discrete apertures comprise apertures of different sizes.

6. The abrasive article of claim 1, wherein the discrete apertures comprise arcuate slots of differing lengths.

7. The abrasive article of claim 1, wherein the discrete apertures expose at least about 75% of the open area.

8. The abrasive article of claim 1, wherein the discrete apertures comprise an area less than about 30 percent of an area of the abrasive article.

9. The abrasive article of claim 1, wherein the discrete apertures comprise seven discrete apertures.

10. The abrasive article of claim 1, wherein the plurality of dust extraction openings comprises five openings.

11. The abrasive article of claim 1, wherein the plurality of dust extraction openings comprises eight openings.

12. The abrasive article of claim 1, wherein the discrete apertures comprise elongated, arcuate slots each having an inner radius of about 1.13 inches (28.70 millimeters) from a center point of the abrasive article and a width of about 0.44 inches (11.18 millimeters).

13. The abrasive article of claim 1, wherein the discrete apertures comprise seven elongated, arcuate slots each having an arc length that ranges from about 0.87 inches (22.10 millimeters) to about 1.06 inches (26.92 millimeters).

14. The abrasive article of claim 1, wherein the discrete apertures comprise three elongated, arcuate slots each having an arc length that ranges from about 2.21 inches (56.13 millimeters) to about 2.57 inches (65.27 millimeters).

15. The abrasive article of claim 1, wherein the discrete apertures are located along a common radius from the center point of the abrasive article.

16. The abrasive article of claim 15, wherein the abrasive article is circular.

* * * * *